US008523471B2

(12) United States Patent
Rolion et al.

(10) Patent No.: US 8,523,471 B2
(45) Date of Patent: Sep. 3, 2013

(54) WRITING IMPLEMENT COMPRISING A SLIDE-ON END MEMBER

(75) Inventors: Franck Rolion, Asnieres sur Oise (FR); Ludovic Fagu, Noisy le Sec (FR)

(73) Assignee: Societe Bic, Clichy (FR)

( * ) Notice: Subject to any disclaimer, the term of this patent is extended or adjusted under 35 U.S.C. 154(b) by 302 days.

(21) Appl. No.: 13/121,628

(22) PCT Filed: Sep. 25, 2009

(86) PCT No.: PCT/FR2009/051828

§ 371 (c)(1), (2), (4) Date: Mar. 29, 2011

(87) PCT Pub. No.: WO2010/037954

PCT Pub. Date: Apr. 8, 2010

(65) Prior Publication Data

US 2011/0182649 A1 Jul. 28, 2011

(30) Foreign Application Priority Data

Oct. 3, 2008 (FR) ..... 08 56730

(51) Int. Cl.
*B43K 23/00* (2006.01)

(52) U.S. Cl.
USPC ..... 401/92; 401/52

(58) Field of Classification Search
USPC ..... 401/92–94, 88, 202, 213, 243, 262, 401/269, 52
See application file for complete search history.

(56) References Cited

U.S. PATENT DOCUMENTS

| | | | | |
|---|---|---|---|---|
| 4,240,759 | A * | 12/1980 | Matsumoto et al. | 401/85 |
| 5,897,266 | A * | 4/1999 | Robert | 401/202 |
| 6,347,898 | B1 | 2/2002 | Rhodes et al. | |
| 2004/0037609 | A1 | 2/2004 | Kageyama | |

FOREIGN PATENT DOCUMENTS

| | | | |
|---|---|---|---|
| DE | 20 2007 001 572 | U1 | 7/2008 |
| EP | 1 434 066 | A1 | 6/2004 |
| JP | 10-203076 | A | 8/1998 |

OTHER PUBLICATIONS

French Preliminary Search Report of FR 0856730.
International Search Report of PCT/FR2009/051828.

* cited by examiner

*Primary Examiner* — David Walczak
(74) *Attorney, Agent, or Firm* — Jones Day

(57) ABSTRACT

A writing implement that includes a deformable hollow body extended along a central axis as far as one end, and an end member that includes a tubular portion which has an inner face equipped with a plurality of first projecting reliefs suitable for engaging with and radially deforming the hollow body during the fitting of the end member by engagement of its tubular portion around the end of the hollow body. The writing implement includes an inner face of the tubular portion that has a plurality of second projecting reliefs having a height measured radially from the inner face which is generally less than the height of the first projecting reliefs and is adapted so that the second reliefs apply a radial pressure on the hollow body deformed by the first reliefs.

9 Claims, 1 Drawing Sheet

WRITING IMPLEMENT COMPRISING A SLIDE-ON END MEMBER

CROSS REFERENCE TO RELATED APPLICATION

This application is a national stage application of International Application No. PCT/FR2009/051828, filed on Sep. 25, 2009, which claims the benefit of French Patent Application No. 0856730 filed on Oct. 3, 2008, the entire contents of both applications being incorporated herein by reference.

FIELD OF INVENTION

The embodiments of the present invention relate to a writing implement that includes a hollow body onto which an end member is slip-fitted. By way of example, it can be a mechanical pencil comprising an inner lead container tube onto which is slip-fitted an eraser holder which also acts as a rear push-button and to facilitate filling the lead container tube with leads.

BACKGROUND OF THE INVENTION

More particularly, the embodiments of the invention relate to a writing implement that includes a deformable hollow body extended along a central axis as far as an end, and an end member that includes a tubular portion which has an inner face with a plurality of first identical projecting reliefs suitable for engaging with and radially deforming the hollow body during the fitting of the end member by engagement of its tubular portion around the end of the hollow body.

The fitting of such an end member must satisfy two types of constraints involving sometimes incompatible solutions, namely on the one hand simplicity of manufacture, making it possible to reduce the overall cost of production, and on the other hand, a sufficiently robust assembly to avoid the user experiencing inopportune detachment of the end member.

It is desirable that the end piece cannot become detached unless an abnormally high pulling force is applied. This is in order to avoid the loss of the end piece which could detract from the appearance of the implement and its functional characteristics, or even result in stains in the case of a ballpoint or felt tip implement. In the particular case of a mechanical pencil, the end member often constitutes a holder receiving an interchangeable eraser, topped by a protective end cap. In addition, this assembly acts as a rear push-button. The fitting of the eraser holder onto the lead container must withstand the pulling forces applied repeatedly during removal of the eraser end cap and extraction of the eraser from its holder.

Moreover, for production, it is advantageous that the end member has shapes corresponding to a mold that is simple to machine, but above all that this member can reliably be removed from the mold at high speeds. Next, it is also preferable that the assembly can be produced rapidly, in particular in an automated process, taking account of the inevitable dimensional dispersions of the hollow bodies and end members produced. In particular, in the case of a mechanical pencil, the lead container tube constituting the hollow member is generally a tube made of extruded polypropylene produced by the meter and cut to length. It can have relatively large variations in outside diameter, inside diameter and radial elasticity. Its substantial length means that it is also relatively sensitive to buckling when a pressure is applied to the free rear end of the latter.

A tubular portion which has inner reliefs, in particular in the form of longitudinal ribs, can be molded easily. In order to reach a compromise between ease of fitting and the required gripping force, it is known to vary the height and the number of these projecting reliefs. But it is found that the number and the height of the reliefs rapidly reach a limit beyond which it is difficult to completely slip fit the end member. In addition, it is found that even if an adequate retaining force is obtained for exact given dimensions of the hollow body and of the end member, this force reduces very substantially in the case of variations in the dimensions, even if these variations remain within ranges that are usual in industrial production.

Moreover, from document JP10-203076 A a solution is known to the problem of the grip of an eraser holder on a lead container which consists of providing a protruding central portion which is inserted inside the lead container tube. But here again, the fitting option and the retaining force are susceptible to the variations of the inner diameter of the lead container tube. In addition, this type of solution makes it almost impossible in practice to refill the lead container by inserting the leads through a hole in the eraser holder.

There is therefore a need in the field of writing implements to improve the fitting of an end piece onto a hollow body, in particular in order to offer a compromise between ease of production and the quality of the grip for the user, while still tolerating some variability in the geometrical dimensions.

SUMMARY OF THE EMBODIMENTS OF THE PRESENT INVENTION

An embodiment of the present invention is directed to a writing implement that includes a deformable hollow body extended along a central axis as far as one end, and an end member that includes a tubular portion which has an inner face equipped with a plurality of first identical projecting reliefs suitable for engaging with and radially deforming the hollow body during the fitting of the end member by engagement of its tubular portion around the end of the hollow body. The inner face of the tubular portion has a plurality of second projecting reliefs having a height measured radially from the inner face which is less than the height of the first projecting reliefs and is adapted so that the second reliefs apply a radial pressure on the hollow body deformed by the first reliefs.

BRIEF DESCRIPTION OF THE DRAWINGS

Other characteristics and advantages will become apparent during the following description of a non-limitative example embodiment, with reference to the figures, in which.

DETAILED DESCRIPTION OF THE EMBODIMENTS OF THE PRESENT INVENTION

The same references in different figures denote identical or similar components.

Figure 1:
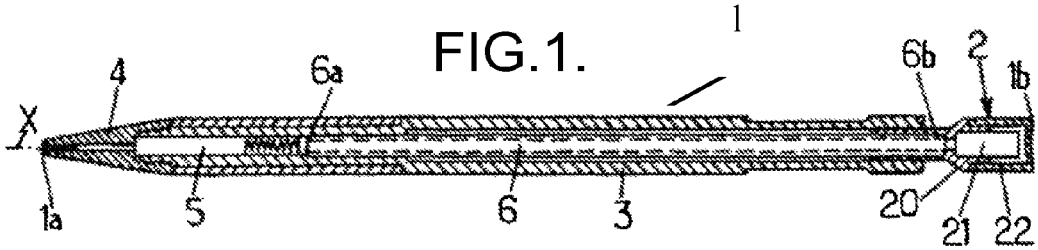
FIG. 1 is a longitudinal sectional view of a writing implement comprising an end member according to the invention slip-fitted onto a hollow body.

FIG. 1 shows in section a writing implement 1 extending along a central axis between a front end 1*a* and a rear end 1*b*. More particularly, in the embodiment shown by way of example, it is a mechanical pencil having an eraser assembly 2 at the rear end 1*b*. The mechanical pencil 1 also comprises a barrel 3 which forms most of the outer body and at the front end 1*b* a conical nose 4 which contains a passage for leads. Inside the barrel 1 is arranged a lead advance mechanism 5 and a lead container tube 6. The container tube 6 is connected at its front end 6*a* to the lead advance mechanism 5 and also has a rear end 6*b* on which the eraser assembly 2 is fitted in a manner that will be detailed hereinafter. The front end 6*a* of the tube 6 is preferably fixed inseparably to the lead advance mechanism 5, for example by being slip-fitted onto a collar-shaped metal rear end of the chuck.

The lead advance mechanism 5 can be compressed longitudinally along the central axis X against an inner stop within the nose 4. This is in order to advance a chuck clamped onto a lead by a ring and to allow the chuck to return to the unclamped condition, as is well known.

The lead container 6 is a hollow body, here made of extruded polypropylene (PP) cut to the required length. This tube has inner and outer walls that are cylindrical in the absence of stresses. The outer diameter of the lead container tube must be less than the inner diameter of the majority of the barrel 3 in order to slide freely therein. Moreover, its inner diameter, shown by broken lines, must be large enough to contain several leads, and preferably at least three leads. The container tube 6 thus constitutes a hollow body having a substantial elongation and a relatively thin wall. It is therefore susceptible to buckling, but must nevertheless still be strong enough to transmit the pressures applied by the user, in particular using the thumb, on the eraser assembly 2 in order to actuate the mechanism 5 and cause the lead to advance.

Figure 2:
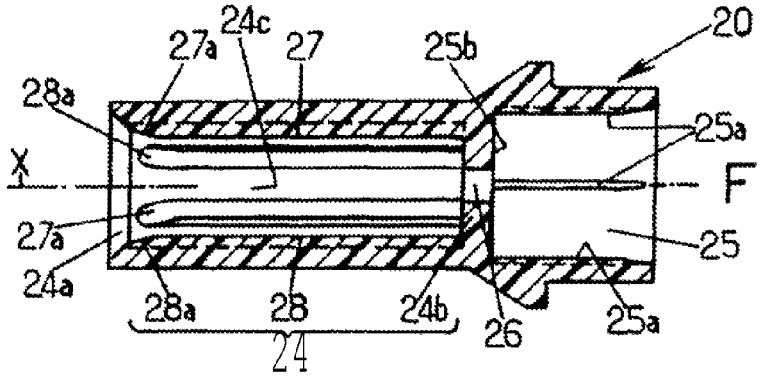
FIG. 2 is an enlarged view of the end member shown in FIG. 1.
Figure 3:
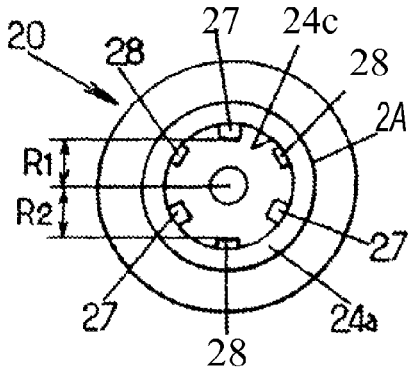
FIG. 3 is a left view of the complete end member shown in section in FIG. 2, and FIGS. 4 and 5 are diagrammatic cross section views of the engagement of a hollow body in an end member of the prior art and in an end member according to an embodiment of the present invention respectively.

The eraser assembly 2 comprises an eraser holder 20 that can be seen in FIGS. 2 and 3, an eraser 21 and an eraser cap 22. As can be better seen in FIG. 2, the eraser holder 20 comprises a tubular portion 24 in the front part thereof. This tubular portion 24 receives the slip-fitted rear end 6*b* of the lead container tube 6. This tubular portion 24 makes it possible to keep the end member constituted by this holder and more generally, the eraser assembly 2, fixed to the mechanical pencil 1. The characteristics of this portion and the fitting procedures will be detailed hereinafter, but it should be noted at this point that the latter are not only applicable to the fitting of an eraser holder onto a lead container tube, but can be applied to the assembly of other mechanical pencil parts, or other writing implements.

More particularly the eraser 21 is received in a cup-shaped housing 25. In order to hold the eraser 21 better and prevent its rotation, four projecting ridges 25*a* are angularly distributed over the inner periphery of the housing 25. The ridges 25*a* all have an identical V-shaped profile which to a greater or lesser extent penetrates into the material constituting the eraser 21. The eraser cap 22 is simply fitted onto an outer peripheral discontinuity of the eraser holder 20. The base 25*b* of the eraser housing 25 is constituted by a wall which has a central opening 26. This opening 26 allows the leads to pass inside the lead container tube 6 when the eraser 21 is removed.

The front tubular portion 24 has an inner face 24*c* which describes a cylinder coaxial to the central axis X. This cylindrical shape promotes resistance to radial stresses, but is not absolutely necessary. The inner face could have a hexagonal profile for example. This tubular portion 24 has an opening 24*a* at its engagement end. Moreover, it is delimited at the rear by a radial wall 24*b* which makes it possible to limit the depth of engagement of the lead container tube 6. This wall 24*b* also constitutes the base 25*b* of the housing 25 of the eraser.

In a known manner, identical first reliefs 27 project from the inner face 24*c* and constitute a first series of three first reliefs. These first reliefs 27 extend globally towards the central axis X on a first height measured radially from the inner face 24*c*. This first height is determined in such a way that the circle inscribed between their apex has a diameter, called first diameter and indicated by the radius R1 in FIG. 3, which is less than the outer diameter of the container tube 6. This outer diameter corresponds to the nominal diameter of the hollow body, i.e. apart from any deformation thereof. Thus, when the lead container tube 6 is slip-fitted into the tubular portion 24, it experiences inward radial deformations at the zones of contact with the first reliefs 27. This creates frictional forces which provide some grip of the eraser holder 20 on the rear end 6*b* of the lead container tube.

The inner face 24*c* also comprises second reliefs 28 which project towards the central axis X. These second reliefs 28, which are preferably but not necessarily identical, constitute a second series of three second reliefs. The second reliefs each preferably have a second height which is less than the first height of the first reliefs. This second height is determined in such a way that the container tube 6 abuts against the second reliefs 28 at least when it is deformed by the first reliefs 27.

It is entirely possible for the second reliefs 28 to have a second height which necessarily involves an engagement with the container tube 6. In this case, the apexes of the second reliefs 28 are at a height such that the circle inscribed between the latter have a diameter, called second diameter and shown by the radius R2, which is also less than the nominal outer diameter of the container tube 6. However, this second diameter R2 must be greater than the first diameter R1, even if by only a few percent, in order to obtain a combined effect on ease of fitting and the grip of the eraser holder 20.

By way of example, satisfactory results were obtained with first reliefs 27 having a height of 0.72 mm for a first diameter R1 of 3.08 mm. Whereas the second reliefs 28 had a height of 0.6 mm for a second diameter R2 of 3.2 mm, and moreover the container tube 6 had a nominal diameter of 3.2 mm+/−0.1 mm. It appears that a slightly lower height of the second reliefs 28 creating a second diameter R2 that is approximately only 4% greater than the first diameter R1, has a notable influence on the grip of the eraser holder 20. A value range for the second diameter R2 2 to 10% greater than the first diameter R1 must give improved results for most of the materials used for the container tube 6.

Figure 4:
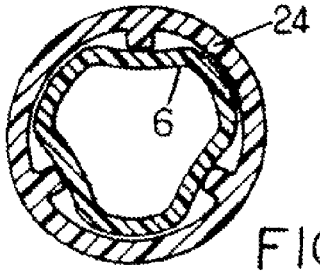
FIG.4. (PRIOR ART)
Figure 5:
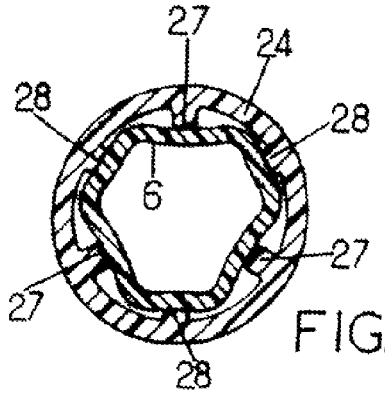

These improved results are apparently explained by a blocking effect achieved by the second reliefs 28, which block the deformations of the hollow bodies 6 created by the first reliefs 27. As diagrammatically shown in FIG. 5 in which the height difference between the first and second reliefs (27, 28) is exaggerated, it appears that the deformation lobe created between the first reliefs 27 and visible in FIG. 4 illustrating the prior art is limited by the presence of the second reliefs 28. This deformation, less substantial overall, of the hollow body 6 is assumed to limit the plastic deformations of the latter while still creating additional contact zones. However, the lower height of the second reliefs 28 means that the initial fitting of the end member 20 onto the hollow body 6 does not require a much greater force. Moreover, re-fitting the end member after an intentional removal allows a satisfactory gripping force to be maintained, even when this re-fitting is repeated.

As shown in FIG. 3, the second reliefs 28, the same in number as the first reliefs 27, are distributed regularly over the circumference of the inner face 24*c* and arranged in a median position between the first reliefs 27. Thus, each deformation lobe of the lead container tube 6 is blocked by a second relief 28 in its largest displacement zone with respect to the nominal outer diameter. It can however be envisaged to limit the number of second reliefs, or also to increase this number, with respect to the number of the first series of first reliefs. For example it is possible to provide two second reliefs 28 between each first relief 27.

The first and second series of first and second reliefs (27, 28) each comprise three reliefs. This number could be four, in particular where there is a substantially greater outer diameter of the hollow body 6. But although this can be envisaged, it appears preferable not to reduce this number to two or increase it beyond four.

The first reliefs 27, as well as the second reliefs 28, are in the form of ribs extending longitudinally over almost the entire extent of the tubular portion 24, except close to the opening 24*a* of this portion where the ribs are in the form of a ramp (27*a*, 28*a*) in order to facilitate the introduction of the container tube 6.

The ribs constituting the first and second reliefs (27, 28) have a square profile in cross section, and even rectangular with a long side oriented towards the central axis X. This profile of the ribs has the advantage of creating a relatively extended contact surface with the lead container tube 6 in the circumferential direction, in any case more extended than with a triangular profile. Damage to the outer surface of the container tube 6 is thus avoided, but it also seems that this arrangement limiting the locally created stresses promotes the grip of the eraser holder 20 after several fittings.

As will have been understood from the description of the embodiment shown by way of example, the number and the form of the first series of first projecting reliefs 27 and of the second series of second projecting reliefs 28 can vary substantially, while still falling within the scope of the present invention defined by the attached claims, which involves an action of the second reliefs 28 of the end member 20 on the hollow body 6 which is a little different in nature and intensity compared with the action of the first reliefs 27.

A subject of the embodiment of the present invention is an eraser holder of the above-mentioned type, characterized in that the inner face of the tubular portion has a plurality of second projecting reliefs having a height measured radially from the inner face which is less than the height of the first projecting reliefs and is adapted so that the second reliefs apply a radial pressure to the hollow body deformed by the first reliefs.

It is found that the presence of the second projecting reliefs does not substantially increase the force to be applied to slip-fit the tubular portion onto the free end of a given hollow body. On the other hand, the fitting grip is increased and above all the gripping force varies less substantially as a function of the non-deformed outer diameter of the hollow body. It is assumed that the second reliefs make it possible to limit overall the size of the deformations of the fitted hollow body, while still benefiting from the deformations created by the first reliefs in order to create additional zones of engagement which apply a radial pressure onto the deformed hollow body. As shown diagrammatically in FIG. 4, the presence of three, or four, relatively high projecting reliefs creates substantial deformation lobes between these reliefs. By using second reliefs, as shown diagrammatically in FIG. 5, the deformation lobes of the hollow body come into contact with the second reliefs, limiting the amplitude of the deformation of the lobes between the first reliefs. It is assumed that the thus-created additional support zones improve the grip by increasing friction. But it is also possible that the amplitudes of the very localized deformations achieved are smaller, and that in this way the material of the hollow body operates to a greater extent within its elastic deformation zone and less within its plastic deformation zone.

In addition, it appears that after one or more inopportune removals, the gripping force deteriorates less rapidly than with the assemblies of identical first reliefs of the prior art.

In preferred embodiments of the present invention, use is also made of one or other of the following measures:

the plurality of second reliefs is regularly distributed circumferentially between the first reliefs; in order to block each of the deformation lobes created by the first reliefs with one or more second reliefs;

each plurality of reliefs comprises an identical number of first and of second reliefs, preferably equal to three or four reliefs;

the first and second reliefs are ribs projecting towards the central axis and extending longitudinally over the inner face of the tubular portion;

the first and second reliefs are ribs having a flattened apex; thanks to this the deformations are applied while avoiding excessively localized concentrations, or even damage to the outer surface of the hollow body;

the ribs have one end in the form of a ramp close to the outlet from the tubular portion and extend over the majority of this portion;

the end member has a first diameter corresponding to the circle inscribed between the apexes of the first reliefs, and a second diameter corresponding to the circle inscribed between the apexes of the second reliefs, the second diameter being 2% to 10% greater than the first diameter, and preferably approximately 4% greater than the first diameter; it appears that a slightly lesser height of the second reliefs is sufficient to ensure that they do not excessively increase the required fitting force;

the hollow body has a nominal outer diameter greater than the first diameter and preferably substantially equal to the second diameter, in order to limit the deformations of the hollow body; and the writing implement further comprises an outer barrel, inside which the hollow body forming a lead container is arranged, and the end member is an eraser holder slidably fitted through the open rear end of the barrel, the assembly formed on the hollow body and the end member being jointly mobile in order to actuate a lead advance mechanism.

The embodiments of the present invention have been described in light of a person of ordinary skill in the art's understanding of the aspects of the invention. Such a person would understand that minor changes in the dimensions and relation of the individual components of the invention will not change the scope of the claims. Where the word "preferred" has been used above, such a person would understand that the word preferred is non-limiting, i.e., other means can be used to satisfy the aspects of the invention.

The invention claimed is:

1. A writing implement comprising:

a deformable hollow body extended along a central axis;

an end member comprising a tubular portion which has an inner face equipped with a plurality of first identical projecting reliefs suitable for engaging with and radially deforming the hollow body during the fitting of the end member by engagement of its tubular portion around the end of the hollow body, wherein the inner face of the tubular portion has a plurality of second projecting reliefs having a height measured radially from the inner face which is less than the height of the first projecting reliefs and is adapted so that the second reliefs apply a radial pressure on the hollow body deformed by the first reliefs.

2. The writing implement according to claim 1, wherein the plurality of second reliefs is regularly distributed circumferentially between the first reliefs.

3. The writing implement according to claim 1, wherein each plurality of reliefs comprises an identical number of first and second reliefs, equal to either three or four reliefs.

4. The writing implement according to claim 1, wherein the first and second reliefs are ribs projecting towards the central axis and extending longitudinally over the inner face of the tubular portion.

5. The writing implement according to claim 4, wherein the tubular portion has an engagement end and an opening at the engagement end, and the ribs have an end in form of a ramp close to the opening and extend over the major part of this tubular portion.

6. The writing implement according to claim 1, wherein the first and second reliefs are ribs having a flattened apex.

7. The writing implement according to claim 1, wherein the end member has a first diameter corresponding to a circle inscribed between the apexes of the first reliefs, and a second diameter corresponding to a circle inscribed between the apexes of the second reliefs, the second diameter being 2% to 10% greater than the first diameter, and approximately 4% greater than the first diameter.

8. The writing implement according to claim 7, wherein the hollow body has a nominal outer diameter greater than the first diameter and substantially equal to the second diameter.

9. The writing implement according to claim 1, further comprising an outer barrel, having an open rear end, the hollow body forming a lead container arranged inside the outer barrel, wherein the end member is an eraser holder slidably fitted through the open rear end, an assembly formed by the hollow body and the end member being jointly mobile in order to actuate a lead advance mechanism.

* * * * *